United States Patent [19]

Hinnant

[11] 4,422,665

[45] Dec. 27, 1983

[54] BOAT TRANSPORTATION AND LAUNCHING MEANS

[76] Inventor: William M. Hinnant, Wendell, N.C. 27591

[21] Appl. No.: 317,285

[22] Filed: Nov. 2, 1981

[51] Int. Cl.[3] ..... B60P 3/10

[52] U.S. Cl. ..... 280/414.2; 114/344

[58] Field of Search ..... 280/414.2, 47.13 B; 114/344

[56] References Cited

U.S. PATENT DOCUMENTS

| | | | |
|---|---|---|---|
| 1,939,863 | 12/1933 | Seiter | 280/47.13 B |
| 2,529,849 | 11/1950 | Oeth | 114/344 |
| 2,540,279 | 2/1951 | Mosier | 280/414.2 |
| 2,688,494 | 9/1954 | Wilson | 280/414.2 |
| 3,068,024 | 12/1962 | Berliner | 280/47.13 B |
| 3,164,392 | 1/1965 | Lane | 280/47.13 B |
| 3,986,723 | 10/1976 | Brockelsby | 280/47.13 B |
| 4,059,282 | 11/1977 | Prickett | 280/47.13 B |
| 4,214,774 | 7/1980 | Kluge | 280/47.13 B |

FOREIGN PATENT DOCUMENTS

| | | | |
|---|---|---|---|
| 175479 | 2/1922 | United Kingdom | 280/414.2 |

*Primary Examiner*—Joseph F. Peters, Jr.
*Assistant Examiner*—Kenneth R. Rice
*Attorney, Agent, or Firm*—Mills and Coats

[57] ABSTRACT

This invention is a transportation and launching device for boats which can be handled by one person. If the boat is carried in a vehicle such as a pick-up truck or station wagon, the device can be left engaged with the boat during the vehicular transport. Thereafter the device is used to move the boat to the edge of the water wherein by the pulling of a lanyard the boat will slide from the device and into the water. Recovery of the boat is equally simple with it being pulled up onto the device with the weight of the boat holding the same in place during transport back to the vehicle, storage area or other desired location.

7 Claims, 8 Drawing Figures

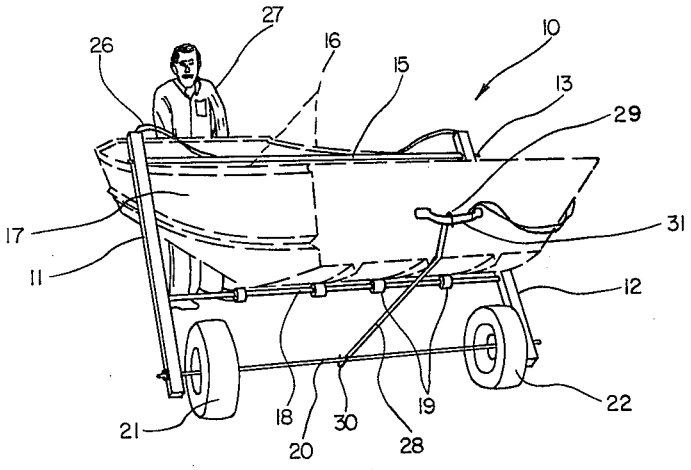
FIG. 1
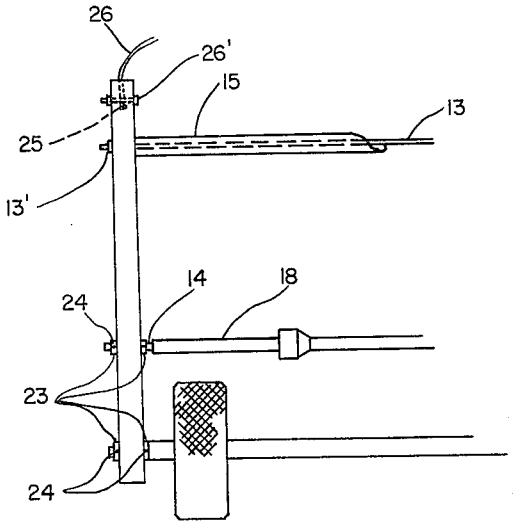
FIG. 1-A

BOAT TRANSPORTATION AND LAUNCHING MEANS

FIELD OF INVENTION

This invention relates to boating equipment and more particularly to devices used in conjunction with the manual transport launching and recovery of boats.

BACKGROUND OF INVENTION

Since man first began using boats for water transportation, the transport of the same across land has been a problem. In the use of small boats which carry only one or two persons such as pond and river fishing boats, the problem is quite often compounded in that the user of the boat cannot get vehicle access to the water's edge and if there is only one person involved, launching can be extremely difficult if not impossible.

Although either removable or retractable wheels have been attached to the sides or one end of boats in an effort to allow more ready transport and launching, these devices are cumbersome, in most cases, heavy, and generally have been found unsatisfactory.

BRIEF DESCRIPTION OF INVENTION

After much research and study into the above-mentioned problems, the present invention has been developed to provide a means for aiding in the transport of a boat and the launching and recovery of the same. This is accomplished through the use of an enclosed frame with roller means on the lower cross member thereof with ground engaging wheels so designed that the boat will sit within the enclosed frame on the rollers during transport with the upper portion of the frame engaging the gunwales of the boat and yet through the pulling of a lanyard, the upper portion of the frame will lift from said gunwales allowing the boat to easily slide through the frame on the rollers. On the other hand, as long as the frame is contacting both the bottom of the boat and the gunwales thereof, the boat can be transported over the terrain with a majority of the weight of the same being supported by said wheels.

When the boat used in conjunction with the present invention is placed in a pick-up truck, station wagon or other vehicle, the transport means of the present invention does not need to be removed thereby adding even further to the utility of the present invention.

In view of the above, it is an object of the present invention to provide a boat transport and launching means which is not connected to the boat itself except through the weight of the same.

Another object of the present invention is to provide a means for transporting a boat from a vehicle to its launching site which is infinitely adjustable as to relative position adjacent the boat.

Another object of the present invention is to provide a boat transport and launching device which is readily placed in use position and removed therefrom.

Another object of the present invention is to provide a boat transport and launching device which can be handled by one person.

Another object of the present invention is to provide a transport and launching device for a flat bottom type boat.

Another object of the present invention is to provide a means for transporting, launching, retrieving a boat by one person wherein said means is not fixedly attached to said boat and can readily be engaged and disengaged therefrom.

Other objects and advantages of the present invention will become apparent and obvious from a study of the following description and the accompanying drawings which are merely illustrative of the same.

BRIEF DESCRIPTION OF DRAWINGS

FIG. 1 is a perspective view of the boat transportation and launching means of the present invention;

FIG. 1-A is a partial view showing one side of the boat transportation and launching means.

DETAILED DESCRIPTION OF INVENTION

Figure 2:
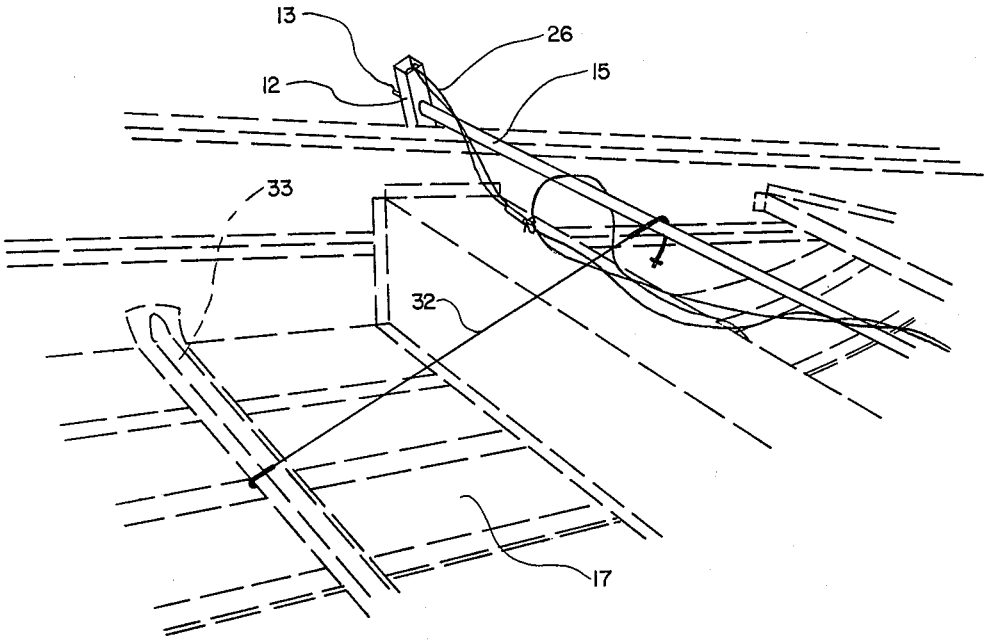
FIG. 2 is a fragmentary interior view of the boat showing the upper part of the transportation and launching means in engagement with the gunwales thereof.

With further reference to the drawings, the boat transportation and launching means of the present invention, indicated generally at 10, includes a pair of opposed end frame members 11 and 12. These frame members are interconnected by a boat gunnel engaging member 13 and a boat bottom engaging cross member 14.

The upper or gunnel engaging cross member 13 preferably has a tube-like outer covering 15 thereover. This covering is so mounted that it can rotate thus making adjusting the transportation means easier as well as preventing marring of the gunnels 16 of the boat 17 being transported.

The lower or bottom engaging cross member 14 has a tube-like covering 18 thereover similar to covering 15 of the upper cross member 13. A plurality of neoprene, rubber or similar resilient rollers 19 are secured at spaced intervals to covering 18.

The size stock from which the lower or bottom engaging cross member 14 is constructed must be of adequate size to prevent any appreciable bending displacement during use and yet not of such a great size as to cause the transportation and launching means 10 to be so heavy as to be difficult to use.

An axial 20 is disposed between end frame members 11 and 12 and rotatively mounts wheels 21 and 22. The mounting of wheels of this type on axles is well known to those skilled in the art and further detailed discussion of this portion of the present invention is not deemed necessary.

Referring more specifically to the detailed construction of the present invention, the upper cross member 13 is preferably in the form of a steel rod threaded at both ends so that nuts indicated at 13′ can be tightened down on either side of the frame members 11 and 12 which are preferably constructed from aluminum box beam type shock.

Both the lower cross member 14 and the axle 20 are held in relative fixed position to each of their respective frame members 11 and 12 by means such as collars 23 which are releasably secured by means such as set screws 24.

Passing through the upper portion of each of the frame members 11 and 12 is a bolt means 25 which is adapted to pass through loop 26' of lanyard 26. Since connections of this type are well known to those skilled in the art, further detailed discussion of the same is not deemed necessary.

To use the transportation and launching means of the present invention, when in the position shown in FIG. 1 the rear or stern of the boat can be placed in the bed of a pick-up truck or station wagon and the user 27 thereof can simply slide the boat in place.

When on the bed of the truck or in the wagon, the wheels 21 will, of course, be off the ground. To ascertain that such wheels remain in relative fixed position, a means such as shock cord 28 with hooks 29 and 30 on each end thereof can be used to biasingly secure the axial 20 to handle 31 on the bow of the boat.

Although not generally necessary, a secondary securing means 32 can be provided between the gunnel engaging cross member 13 and any convenient portion of the boat such as stringer 33. This is generally only done during long transports or when traveling over unimproved roads or rough terrain.

Figure 3:
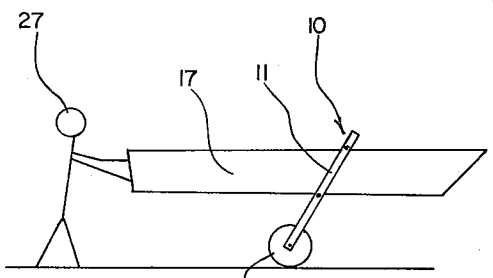
FIG. 3 is a schematic view of the boat being transported from the stern.

To launch the boat 17 using the transportation and launching means of the present invention, the user 27 removes any securing means such as those indicated at 32 and 28 and then simply picks up one end of the boat and guides it to the desired launching site while balanced on wheels 21 as shown schematically in FIG. 3. It should be noted at this point that either the bow or stern of the boat can be manipulated by the user interchangeably, depending on which end is more convenient at the time.

Figure 4:
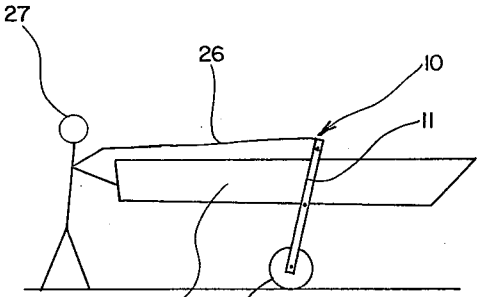
FIG. 4 is a schematic view showing the lanyard being manipulated to place the boat in launched position.
Figure 5:
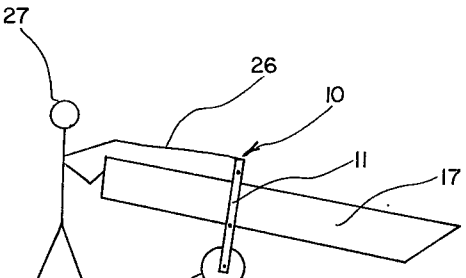
FIG. 5 is a schematic view showing the boat in the launching process.

Once the boat 17 is adjacent the launching area, the lanyard 26 can be pulled, as indicated schematically in FIG. 4, to move frame members 11 and 12 into a position approaching vertical (but still not passing vertical which would cause the frame to fall in the opposite direction toward the user).

While still holding the lanyard 26, the user 27 allows the boat to slide through the frame formed by members 11, 12, 13, and 14 by rolling therethrough on rollers 19. Once the boat is in the water, the transportation and launching means 10 can be moved up on the bank and left or placed in the boat as deemed appropriate.

Figure 6:
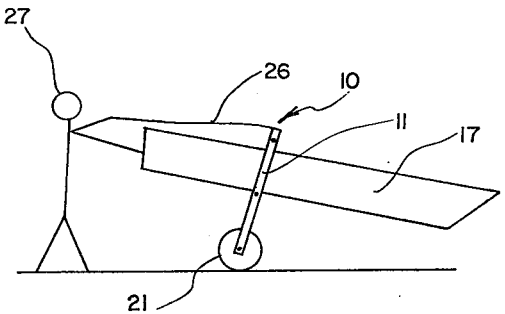
FIG. 6 is a schematic view showing the boat being retrieved.

When it is time to recover the boat, the transportation and launching means 10 is placed either in the water or on the edge of the water and either the stern or the bow of the boat pulled up onto rollers 19 as shown in FIG. 6. The user 27 can manipulate the lanyard 26 as necessary to aid in this portion of the loading process.

Figure 7:
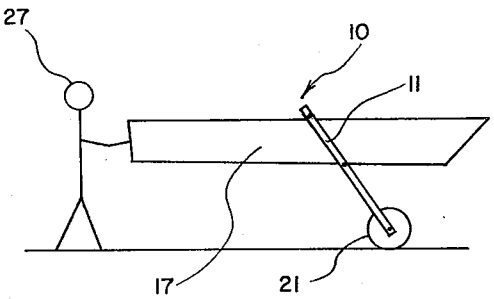
FIG. 7 is a schematic view showing the boat being transported from the bow.

When the transportation and launching means 10 is in the proper location under the central portion of boat 17, the lanyard can be pulled slightly to cause the transportation means 10 to fall by gravity to the position shown in FIG. 7 causing a binding action and more or less locking the boat 17 therewithin. The user 27 then can transport the boat to either another launching location, back to his truck or station wagon, or to any of the desired location. To relaunch the boat it is simply a repeat of the above set forth process.

Again it should be pointed out that as illustrated in FIGS. 3 and 7, the boat 17 can be manipulated by the user 27 from either end thereof with the transportation and launching means 10 of the present invention operating equally as well in both instances.

From the above it can be seen that the present invention provides a non-connected, non-modifying means for transporting, launching and recovering a boat by a single participant with a minimum of effort being expended. The launching and recovery operations are easily performed as is the transport of the balanced boat. The present invention is also relatively inexpensive to manufacture and yet is highly efficient in operation.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A boat type transportation, launching and recovery means for use in conjunction with boat type device having end portions, sides and a bottom comprising: a pair of upright means; means extending between said upright means for supportingly engaging said bottom of said boat type device; means extending between said upright means for engaging the upper edge of said sides of said boat type device; and wheel means rotatively mounted adjacent the lower portion of said upright means whereby an improved boat type transportation, launching and recovery means is provided.

2. The means of claim 1 wherein said member extending between said upright members for engaging upper edge of the sides of said boat type device has a cover over at least a portion of the same.

3. The means of claim 2 wherein said cover means is formed from a tubular type material.

4. The means of claim 1 wherein the means extending between said upright means for supportingly engaging said bottom of said boat type device includes at least one resilient roller type means.

5. The means of claim 1 wherein a lanyard type device is connected to the upper portion of at least one of said upright means whereby the transportation, launching and recovery means of the present invention can be more readily manipulated.

6. The means of claim 1 wherein said wheel means are mounted on an axle means secured to and extending between said upright means.

7. The means of claim 6 wherein a pair of wheels are provided, one being disposed adjacent each of said upright means.

* * * * *